US005943699A

United States Patent [19]

Barbeau

[11] Patent Number: 5,943,699

[45] Date of Patent: Aug. 31, 1999

[54] FIREFIGHTER PROTECTIVE TURNOUT PANT

[75] Inventor: Claude Barbeau, Québec, Canada

[73] Assignee: Marcanada Inc., Québec, Canada

[21] Appl. No.: 08/689,394

[22] Filed: Aug. 12, 1996

[51] Int. Cl.[6] ..... A41D 13/00

[52] U.S. Cl. ..... 2/81; 2/79; 2/227

[58] Field of Search ..... 2/79, 81, 227, 2/270

[56] References Cited

U.S. PATENT DOCUMENTS

| | | | |
|---|---|---|---|
| 269,479 | 12/1882 | Stretch et al. | 2/227 |
| 932,990 | 8/1909 | Madill et al. | 2/227 |
| 1,885,527 | 11/1932 | Luft | 2/227 |
| 4,766,613 | 8/1988 | Wells . | |
| 5,031,242 | 7/1991 | Aldridge et al. | 2/81 |
| 5,153,944 | 10/1992 | Teel . | |

*Primary Examiner*—Diana Oleksa
*Attorney, Agent, or Firm*—Swabey Ogilvy Renault

[57] ABSTRACT

The firefighter's turnout pants according to the invention are designed so that each pant leg comprises a front panel and a back panel above the knee region, the panels being joined by an outseam and an inseam, and cylindrical panels below the knee region, the cylindrical panels being each joined by only an outseam and connected via a circumferential seam at the knee to the two-panels above the knee. The absence of an inseam below the knee of the firefighter's pants eliminates a chronic problem of abrasion of the threads used in that portion of the inseam and subsequent failure of the inseam. The absence below the knee of an inseam with the potential for failure reduces the maintenance and repair of the firefighter pants, reduces the risk of burn injury resulting from a breach in the protective envelope of the firefighter's pants, and reduces the incidence of reflective trim becoming coincidentally detached from the pants.

13 Claims, 7 Drawing Sheets

FIREFIGHTER PROTECTIVE TURNOUT PANT

BACKGROUND OF THE INVENTION (a) Field of the Invention

This invention relates to the design and assembly of a firefighter's protective trousers wherein the aforesaid design and consequent assembly eliminate the existence of a trouser leg inseam from the knee region to the cuff of the pant leg.

(b) Description of Prior Art

Firefighter turnout pants usually consist of three or more discrete layers of heat and flame resistant materials, normally:

1. the outer shell which provides protection against flame, heat, scrapes, puncture and cuts;
2. the moisture barrier, consisting of substrate and moisture barrier film or coating, which has as its principal purpose the prevention of penetration of liquid water;
3. the thermal barrier, most often consisting of a thermal insulating material and lining fabric, whose principal function is to provide insulation against heat transfer.

Firefighter pants are normally constructed in either of two ways. In one, the pant outer shell consists of four main panels: one left front panel, one left rear panel, one right front panel, one right rear panel. The panels are joined by an outseam running from the cuff to the waist band, by an inseam running from the cuff to the crotch, by a seat seam and by a crotch seam and fly of the pant. In the other, the pant outer shell is comprised of two main panels: essentially one left cylinder and one right cylinder. Each cylinder is closed by either an outseam or an inseam and joined to the other cylinder by a seat seam and a crotch seam and fly of the pant. (The moisture barrier and thermal barrier construction may or may not be identical to that of the outer shell.)

The four-panel method of construction is generally considered to offer superior comfort and fit to the two-panel. However, the four-panel system, as well as the two-panel system with inseam, has an inseam which is subject to abrasion as the inside of the pant legs rub together when the pants are worn. The seam abrasion, or more particularly seam thread abrasion, is exacerbated by several factors:

1. The outer shell material, which is usually made with Nomex®, Kevlar® or similar fire resistant synthetic yarns is stiffer and more abrasive than traditional textile fabrics. In general, the higher the percentage of high tenacity yarn, e.g. Kevlar®, in the outer shell, the more severe is the problem of abrasion.
2. The pant consists of three or more layers thereby adding to the stiffiess of the garment and its outer shell.
3. The firefighter is wearing rubber or leather, calf-high or knee-high, boots under the pant; these boots present a semi-rigid surface that prevents the seam from retreating from any abrasive surface.
4. The national standards for firefighter turnout pants mandate that each pant leg be encircled between the knee and the cuff by a band of reflective tape whose purpose is to increase firefighter visibility and safety. The ends of the band of reflective tape are normally tucked and sewn into the inseam. However, the reflective tape has a relatively hard surface with the result that the seaming thread cannot imbed itself into the surface of the tape the way it might into the surface of a fabric. As a result, the inseam thread is particularly vulnerable to abrasion where it passes over this circumferential band of reflective tape.
5. An ensemble of firefighter pants and boots is bulky and cumbersome with the result that there is considerably more rubbing of the inseam of firefighter pants than there is with more conventional pants.

In one possible configuration of the two-panel method of constructing a firefighter pant there is no inseam to be subject to abrasion; there are only outseams. However, the fit and comfort disadvantages in the thigh and lower torso regions of the wearer of a two-panel system lead most users to prefer a four-panel system in spite of the problem with inseam abrasion. And for the two-panel method with an inseam instead of an outseam, the problem of inseam abrasion would be similar to that experienced with a four-panel design.

U.S. Pat. No. 5,031,242 describes a firefighter's pants wherein the knee joint sections include a bellow. The stated purpose of this design is to increase protection, flexion range and comfort. This design does not simplify the design nor reduce the possibility of seam failure; on the contrary, by introducing an additional section of material, the number of seams exposed to abrasion and failure is increased.

Furthermore, it envisages turnout pants with each pant leg constructed from a single piece of material rolled into a cylindrical shape and joined by an outseam but with a knee bellow and rectangular section completely encircling the knee joint and thereby sectioning the pant leg into a top section, a knee bellow section, and a bottom section.

Alternatively, it allows for a pant leg having a front panel and a back panel joined together with an outseam and an inseam and with the knee joint section either completely encircling the knee area, thereby sectioning the pant leg into two upper panels and two lower panels connected by the knee joint section, or sectioning only the front panel, thereby creating one continuous back leg panel and two front leg panel, the latter being joined by the knee joint section. In this embodiment there is still a continuous inseam from waist to cuff.

It does not envisage a pant with a front panel and back panel above the knee—joined by an outseam and an inseam—and a single cylindrical piece of material below the knee joined only with an outseam.

U.S. Pat No. 269,479 describes pants in which the portion of the pant leg from the knee down is removable thereby permitting the pants to be worn either as knee breeches or long pants.

Similarly U.S. Pat. Nos. 4,766,613 and 5,153,944 describe trousers which are convertible from long to short modes of wear via removable lower sections.

SUMMARY OF THE INVENTION

It is a feature of the present invention to solve the problem of inseam failure inherent in prior art firefighter turnout pants and by so doing reduce the need for repair of the inseam on firefighter turnout pants without sacrificing the superior fit and comfort characteristics of four-panel pant construction.

It is another feature of the present invention to increase firefighter safety by reducing the instances of failure of that part of the inseam that anchors the reflective trim on the firefighter's trousers. The purpose of reflective trim is to increase firefighter visibility. If the reflective trim detaches from the trousers because of seam failure, the firefighter is less visible and therefore potentially less safe.

It is another feature of the present invention to increase firefighter safety by reducing the incidence of inseam failure, which failure constitutes a breach in the flame and heat barrier provided by the outer shell of the firefighter turnout pants.

According to the invention, there is provided a firefighter turnout pants comprising a) an upper portion extending from the waist to substantially the knee region of the pants;

b) a lower portion extending from the knee region to the cuff of the pants, the lower pant portion comprising i) a right tubular pant leg and a left tubular pant leg, ii) each tubular pant leg being closed by a pant leg outseam, and leaving its inner part substantially free of any seam; and c) a substantially circumferential seam to join each tubular pant leg to the upper portion of the turnout pants.

In accordance with a preferred embodiment, the upper pant portion comprises ai) right and left front outer shell panels, aii) right and left back outer shell panels, aiii) a first outseam and a first inseam to join the right front outer shell panel and the right back outer shell panel to form a right side section;

aiv) a second outseam and a second inseam to join the left front outer shell panel and the left back outer shell panel to form a left side section.

The firefighter turnout pants according to the invention may comprise a crotch seam and fly and a seat seam to join together the right and left sections.

In accordance with yet another embodiment, the upper portion comprises a single right panel and a single left panel, a third inseam to close each single panel into a tubular part extending from the knee region to the crotch and seat of the pants, and seam means to join single right and left panels together.

According to another embodiment, the lower portion is made of the same material as the upper portion or is made of different material than the upper portion. Both the upper portion and the lower portion are made of fire resistant fabric. The lower portion may also be made of leather. Finally either or both the lower and upper portions may be made of synthetic material, or of composite material.

In accordance with another embodiment, a patch may be applied to the lower portion and it may be joined to the lower portion through the circumferential seam and patch seams to fix the remaining periphery of the patch to the lower portion. The patch may be made of outer shell fabric, leather, synthetic or composite material, or the like.

According to yet another embodiment, at least part of each pant leg outseam may be replaced by a zipper opening which extends from the cuff towards the circumferential seam.

DESCRIPTION OF PREFERRED EMBODIMENTS

Figure 1:
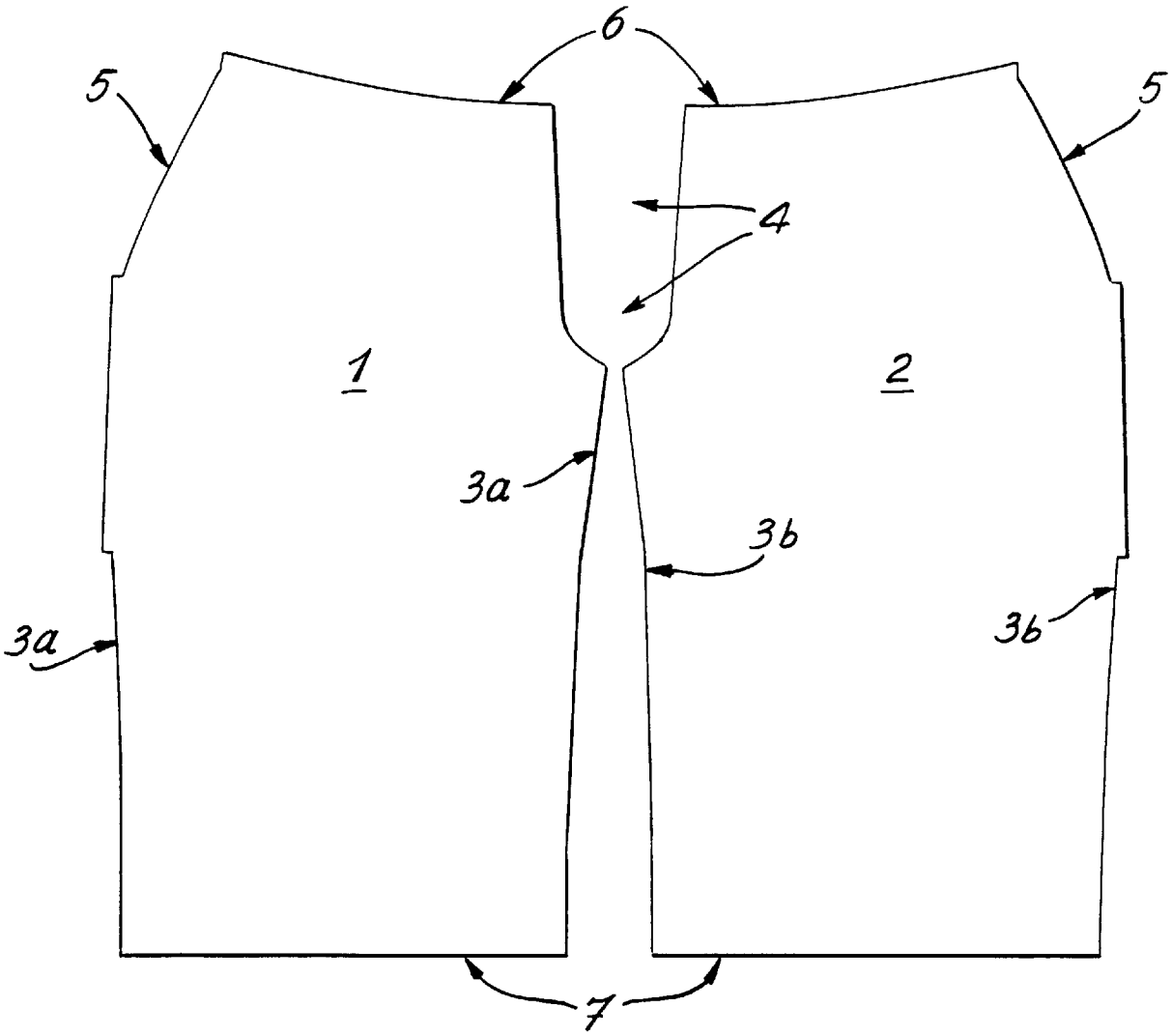
Fig. 1 (PRIOR ART)
FIGS. 1 and 2 are views of the patterns for the outer shell of prior art fire fighter turnout pants.
Figure 2:
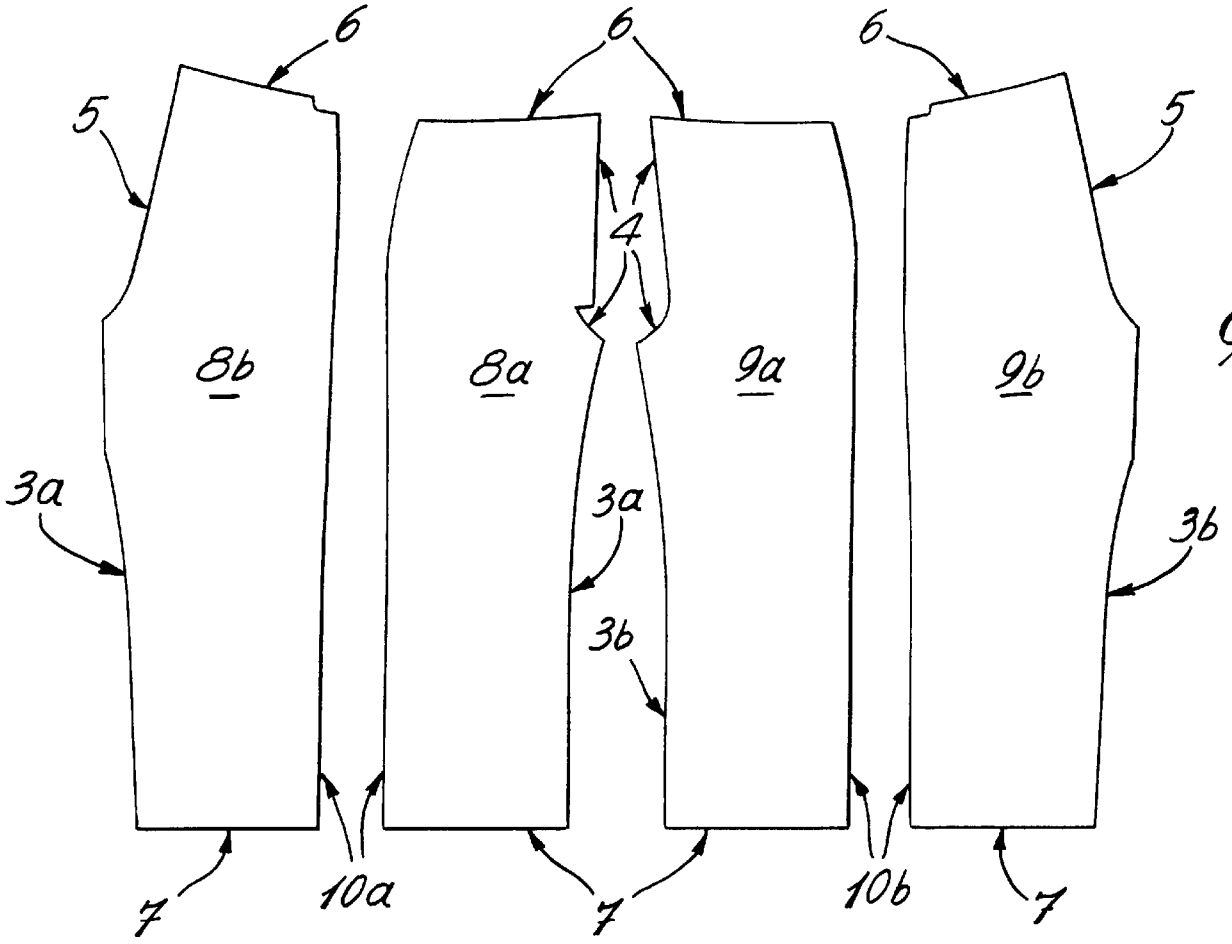
Fig. 2 (PRIOR ART)
Figure 3:
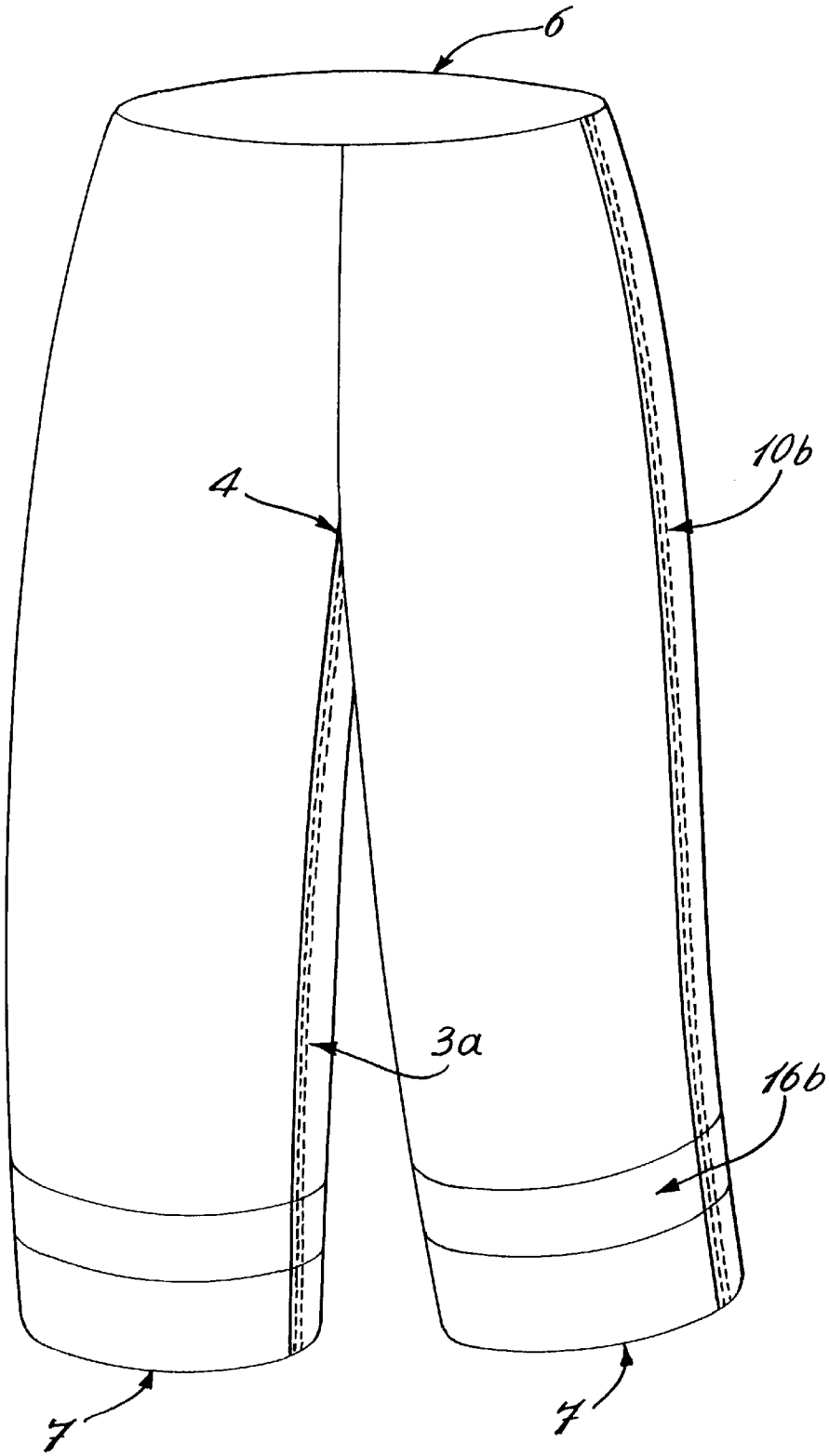
Fig. 3 (PRIOR ART)
FIG. 3 is a view of an assembled prior art firefighter pant.

Referring now to the drawings, FIG. 1 and FIG. 2 show prior art firefighter's turnout pants. FIG. 1 is a plan view of a pattern of the right 1 and left 2 outer shell panels of a two-panel system wherein each panel is closed with an inseam 3*a* and 3*b* and joined to the other panel by a crotch seam and fly 4 and by a seat seam 5. The inseam is continuous from the crotch seam 4 to the cuff 7. FIG. 12 is a plan view of the pattern of the right front 8*a* and right rear 8*b* outer shell panels and of the left front 9*a* and left rear 9*b* outer shell panels of a four-panel system wherein the two right panels 8*a* and 8*b* are to be joined by an inseam 3*a* and an outseam 10*a*, as is the case for the two left panels 9*a* and 9*b* to be joined by inseam 3*b* and outseam 10*b*. Sections 8*a* and 8*b* and 9*a* and 9*b* are to be joined together by a seat seam 5 and by a crotch seam and fly 4. The outseams are continuous from the waist line 6 to the cuff 7 of the pant. FIG. 3 is a drawing of an assembled firefighter turnout pant showing the left continuous outseam 10*b* and right inseam 3*a* from waist 6 to cuff 7 and from crotch 4 to cuff 7 respectively. Bands of reflective tape 16*a* and 16*b* are sewn to each pant leg between the pant knee and the pant cuff. The stitching of the right inseam 3*a* can be seen passing over the reflective tape.

Figure 4:
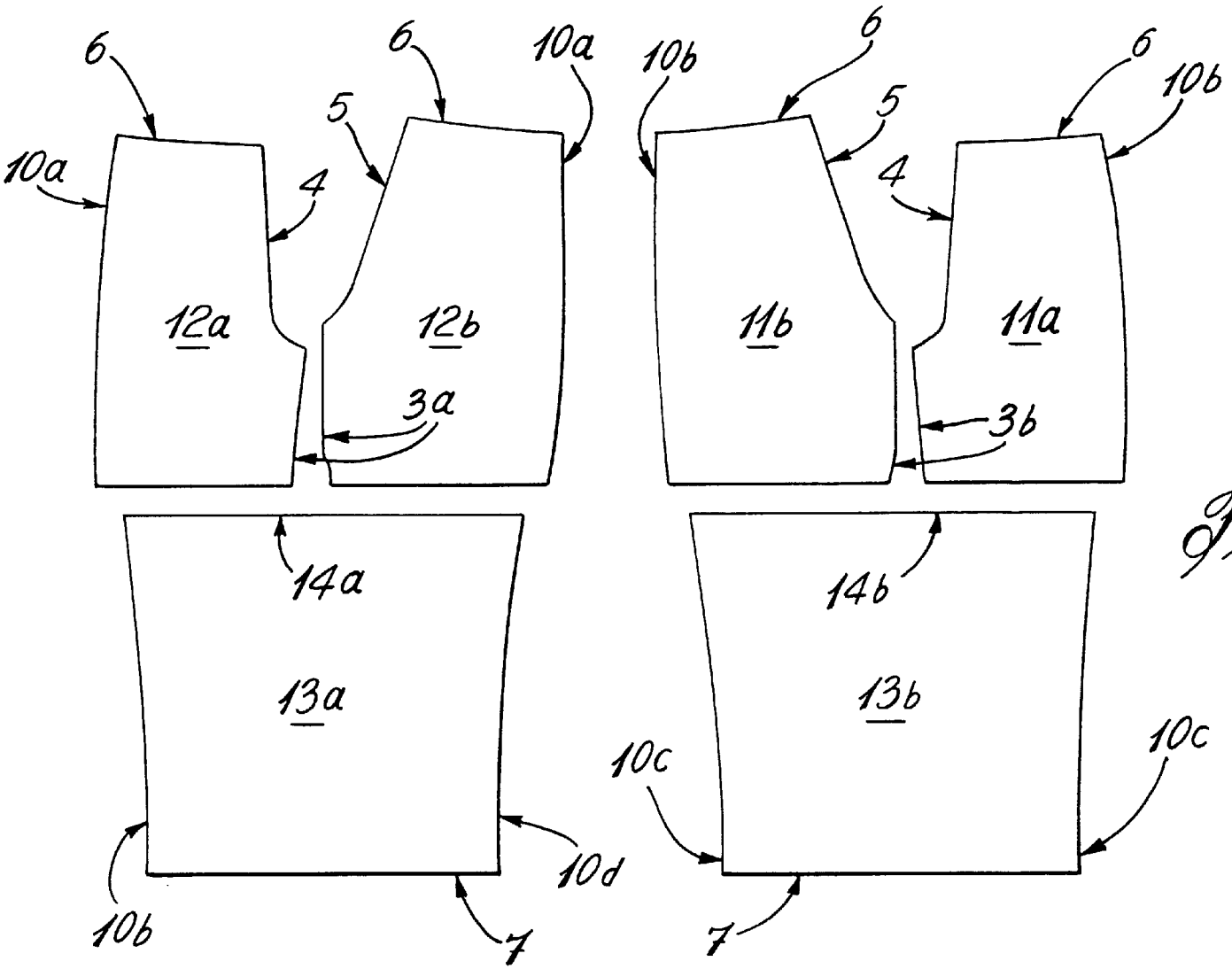
FIG. 4 is a view of the pattern of the outer shell showing the sections in accordance with the present invention.

Now FIG. 4 is a plan view of a pattern according to the present invention showing the six main outer shell panels: an upper left front 11*a* and an upper left rear 11*b* panels which are to be joined together by an outseam 10*b* and an inseam 3*b*; an upper right front 12*a* and an upper right rear panel 12*b* which are to be joined together by an outseam 10*a* and an inseam 3*a*. The left and right upper pant portions are to be joined to each other by a crotch seam and fly 4 and by a seat seam 5. The lower left leg portion 13*b* and lower right leg portion 13*a* are attached to the upper leg portions by circumferential seams 14*b* and 14*a* respectively. The left and right lower leg portions 13*a* and 13*b* are closed via outseams 10*d* and 10*c* respectively.

Figure 5:
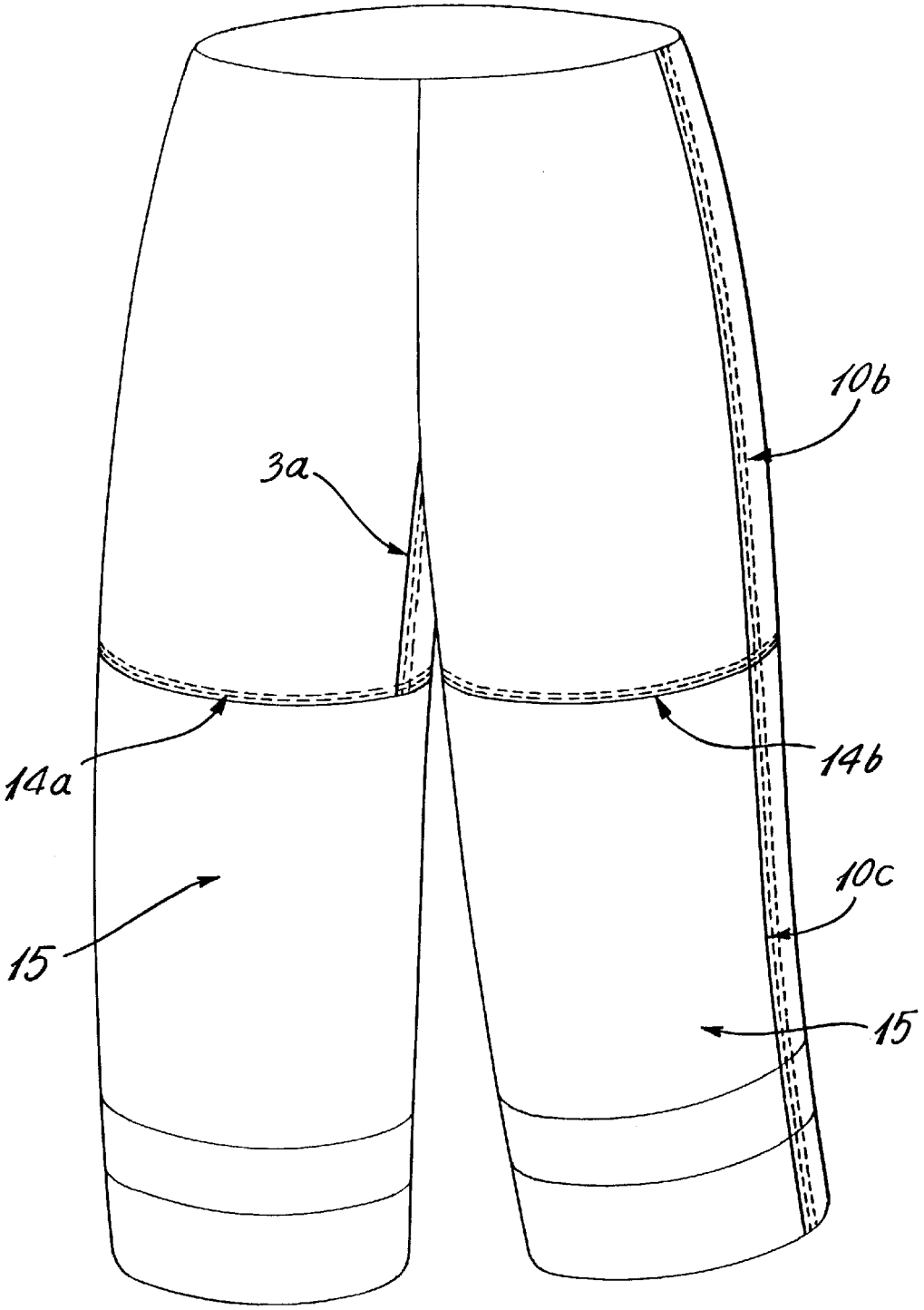
FIG. 5 is a view of an assembled firefighter turnout pant incorporating the present invention.

FIG. 5 of the drawings shows a front oblique view of the assembled firefighter turnout pants incorporating the present invention. The drawing shows the right inseam 3*a* and the left outseam 10*b* stopping at the knee region 15 of the pant. The circumferential knee seams 14*a* and 14*b* joining the upper pant portions to the lower pant leg portions are also shown. The absence of an inseam on the right pant leg is evident. It can be seen that the upper and lower pant portions are assembled so that the outseams, for example 10*b* and 10*c* on the left pant leg are aligned. Although the outseams 10*b* and 10*c* are shown to be aligned in FIG. 5, this is not an essential condition as will readily be understood by one skilled in the art.

Figure 6:
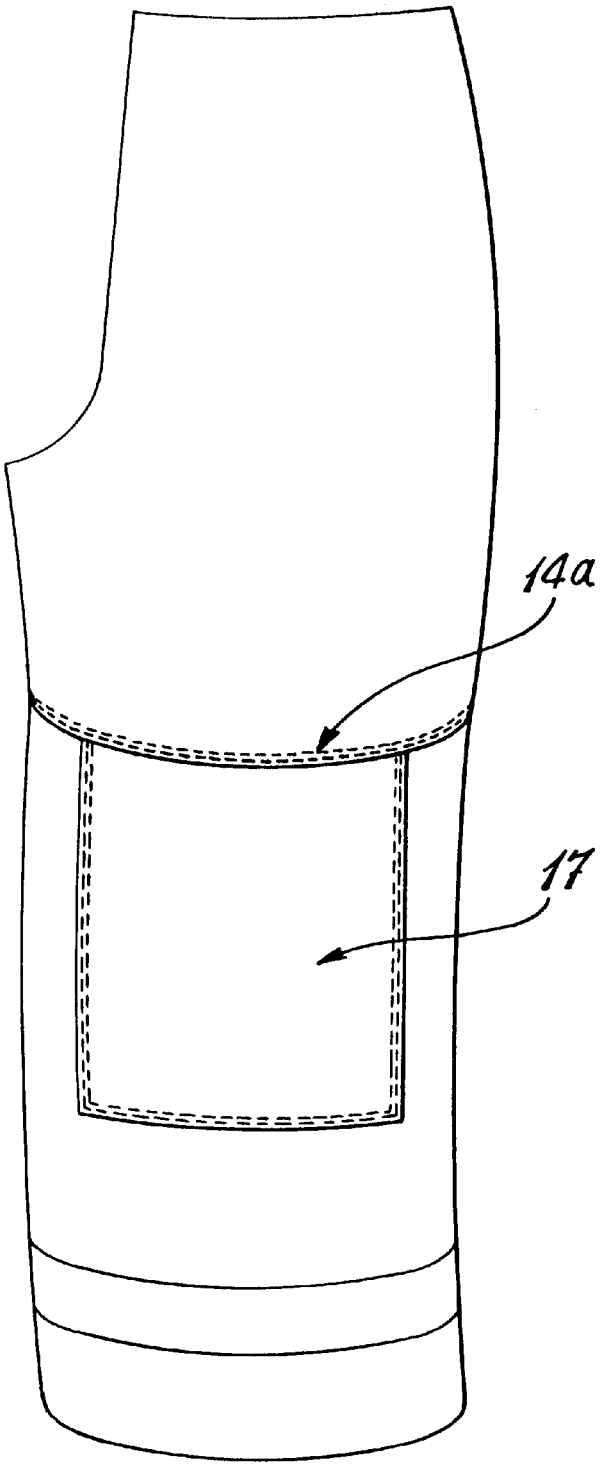
FIG. 6 is a view of an assembled firefighter turnout pant showing the incorporation of a reinforcing patch into the lower leg portion of the pant.

FIG. 6 is a front view of the area of the left pant leg above and below the knee region of a firefighter turnout pant with the present invention. In this drawing a reinforcing patch 17 of another material is attached to the lower leg portion of one pant leg. The upper edge of the reinforcing patch is incorporated into the circumferential knee seam 14*b*. By incorporating the reinforcing patch in the circumferential seam 14*b*, the abrasion of the seam thread holding the upper edge of the patch to the pant leg is greatly reduced. Furthermore, the specific purpose of the patch is to add abrasion resistance, cushioning, or increased thermal insulation to the lower leg portion, and more particularly when the patch is joined to the lower leg portion using the same circumferential seam that joins the lower leg portion of the pant to the upper pant portion.

Figure 7:
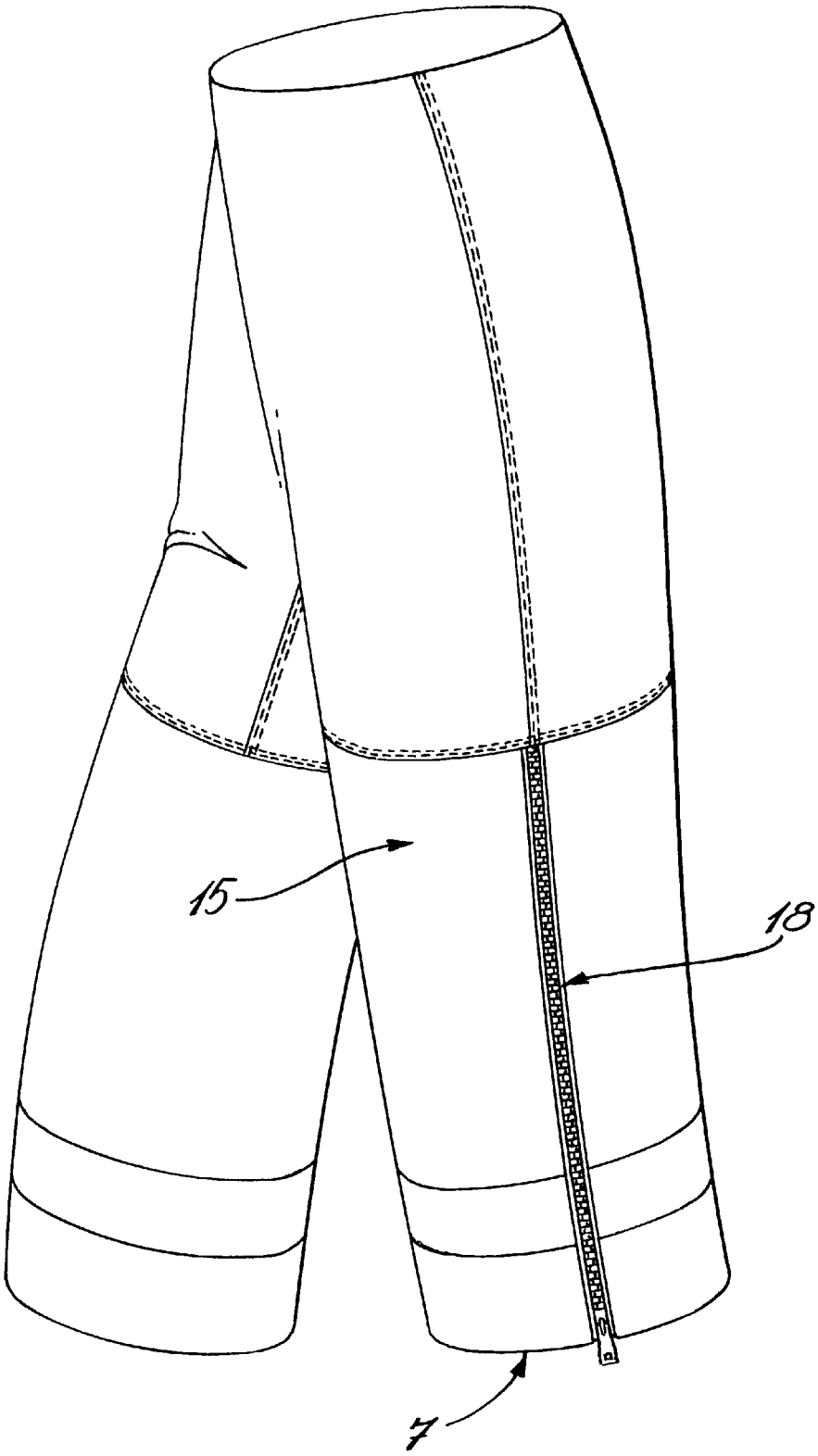
FIG. 7 is an enlarged side view of one pant leg with the invention showing a zipper in the place of the lower leg portion outseam.

FIG. 7 is a side view of an assembled pant leg incorporating the present invention wherein the outseam, 10*c* or 10*d*, of the lower portion of the pant leg has been replaced by a zipper 18 opening from the cuff 7 up to the knee region 15 of the pant leg.

Although the invention has been described with respect to a specific embodiment, it is understood that it is not restricted thereto except as defined in the appended claims.

I claim:

1. Firefighter turnout pants comprising a) an upper portion extending from a waist of said pants to substantially a knee region of said pants; said upper portion comprising ai) right and left front outer shell panels, aii) right and left back outer shell panels, aiii) a first outseam and a first inseam joining the right front outer shell panel and the right back outer shell panel to form a right side section; and aiv) a second outseam and a second inseam joining the left front outer shell panel and the left back outer shell panel to form a left side section;

b) a lower portion extending from said knee region to a cuff of said pants, said lower pant portion comprising i) a right tubular pant leg and a left tubular pant leg, ii) each said tubular pant leg being closed by a pant leg outseam, and an inner part of each said tubular pant leg being substantially free of any seam; and c) a substantially circumferential seam joining each said tubular pant leg to said upper portion of said turnout pants.

2. Firefighter turnout pants according to claim 1, which comprise a crotch seam and fly and a seat seam which join together said right and left sections.

3. Firefighter turnout pants according to claim 1, wherein said lower portion is made of the same material as the upper portion.

4. Firefighter turnout pants according to claim 3, wherein both said upper portion and said lower portion are made of synthetic material.

5. Firefighter turnout pants according to claim 3, wherein both said upper portion and said lower portion are made of composite material.

6. Firefighter turnout pants according to claim 1, wherein said lower portion is made of different material than the upper position.

7. Firefighter turnout pants according to claim 6, wherein said lower portion is made of leather.

8. Firefighter turnout pants according to claim 6, wherein said lower portion is made of synthetic material.

9. Firefighter turnout pants according to claim 6, wherein said lower portion is made of composite material.

10. Firefighter turnout pants according to claim 1, which comprises a patch applied to the lower portion.

11. Firefighter turnout pants according to claim 10, wherein said patch is joined to the lower portion through said circumferential seam and patch seams are provided fixing a remaining periphery of said patch to said lower portion.

12. Firefighter turnout pants according to claim 10, wherein said patch is made of outer shell fabric, leather, synthetic or composite material.

13. Firefighter turnout pants according to claim 1, wherein at least part of each pant leg outseam includes a zipper opening which extends from the cuff towards the circumferential seam.

* * * * *